US009233450B2

(12) United States Patent
David et al.

(10) Patent No.: US 9,233,450 B2
(45) Date of Patent: Jan. 12, 2016

(54) OPTICAL DETECTION OF METAL LAYER CLEARANCE

(75) Inventors: Jeffrey Drue David, San Jose, CA (US); Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 581 days.

(21) Appl. No.: 13/584,565

(22) Filed: Aug. 13, 2012

(65) Prior Publication Data

US 2013/0052916 A1 Feb. 28, 2013

Related U.S. Application Data

(60) Provisional application No. 61/526,585, filed on Aug. 23, 2011.

(51) Int. Cl.

| | |
|---|---|
| ***B24B 37/013*** | (2012.01) |
| ***B24B 37/04*** | (2012.01) |
| ***B24B 49/12*** | (2006.01) |

(52) U.S. Cl.

CPC ..... *B24B 37/013* (2013.01); *B24B 37/042* (2013.01); *B24B 49/12* (2013.01)

(58) Field of Classification Search

CPC .. B24B 37/013; B24B 37/042; B24B 37/205; B24B 49/04; B24B 49/12

USPC ..... 451/5, 6

See application file for complete search history.

(56) References Cited

U.S. PATENT DOCUMENTS

| | | | | |
|---|---|---|---|---|
| 6,071,177 | A * | 6/2000 | Lin et al. | 451/6 |
| 6,106,662 | A * | 8/2000 | Bibby et al. | 156/345.13 |
| 6,271,047 | B1 * | 8/2001 | Ushio et al. | 438/14 |
| 6,676,482 | B2 * | 1/2004 | Bibby et al. | 451/6 |
| 7,764,377 | B2 | 7/2010 | Benvegnu et al. | |
| 2007/0042675 | A1 * | 2/2007 | Benvegnu et al. | 451/5 |
| 2008/0099443 | A1 * | 5/2008 | Benvegnu et al. | 216/84 |
| 2008/0138988 | A1 | 6/2008 | David et al. | |
| 2010/0129939 | A1 * | 5/2010 | David et al. | 438/8 |
| 2010/0185314 | A1 * | 7/2010 | Xu et al. | 700/109 |
| 2011/0104987 | A1 | 5/2011 | David et al. | |
| 2012/0064801 | A1 | 3/2012 | Xu et al. | |

OTHER PUBLICATIONS

International Search Report and Written Opinion in International Application No. PCT/US2012/050607, dated Dec. 26, 2012, 11 pages.

* cited by examiner

*Primary Examiner* — Lee D Wilson
*Assistant Examiner* — Tyrone V Hall, Jr.
(74) *Attorney, Agent, or Firm* — Fish & Richardson P.C.

(57) ABSTRACT

A method of controlling polishing includes polishing a metal layer of a substrate. The metal layer overlies an underlying layer structure. During polishing of the metal layer, a light beam is directed onto the first substrate. The metal layer is sufficiently thin that a portion of the light beam reflects from an exposed surface of the metal layer and a portion of the light beam passes through the metal layer and reflects from the underlying layer structure to generate a reflected light beam. The reflected light beam is monitored during polishing and a sequence of measured spectra is generated from the reflected light beam. At least one of a polishing endpoint or an adjustment for a polishing rate is determined from the sequence of measured spectra.

18 Claims, 5 Drawing Sheets

OPTICAL DETECTION OF METAL LAYER CLEARANCE

CROSS-REFERENCE TO RELATED APPLICATIONS

This application claims priority to U.S. Provisional Application Ser. No. 61/526,585, filed on Aug. 23, 2011, which is incorporated herein by reference.

TECHNICAL FIELD

This disclosure relates to using optical monitoring to control polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time.

In some systems, a substrate is optically monitored in-situ during polishing, e.g., through a window in the polishing pad. However, existing optical monitoring techniques may not satisfy increasing demands of semiconductor device manufacturers.

SUMMARY

Due to the variations discussed above, an overlying layer can be cleared from different regions of a substrate at different times. For some materials, particularly metals (but also other materials with a similarly high extinction coefficient), optical monitoring has not reliably detected the thickness of the layer being polished. However, at sufficiently small thicknesses, light will pass through even a layer with a relatively large extinction coefficient. The light that passes through the overlying layer can be reflected off the underlying layer, and can interfere with light reflected from the surface of the overlying layer, creating a spectrum that depends on the thickness of the overlying layer. Spectrographic analysis can therefore be used to reliably determine the polishing endpoint on metal clearance or with very thin metal layers.

In one aspect a method of controlling polishing includes polishing a metal layer of a substrate. The metal layer overlies an underlying layer structure. During polishing of the metal layer, a light beam is directed onto the first substrate. The metal layer is sufficiently thin that a portion of the light beam reflects from an exposed surface of the metal layer and a portion of the light beam passes through the metal layer and reflects from the underlying layer structure to generate a reflected light beam. The reflected light beam is monitored during polishing and a sequence of measured spectra is generated from the reflected light beam. At least one of a polishing endpoint or an adjustment for a polishing rate is determined from the sequence of measured spectra.

Implementations can include one or more of the following features. The light beam may be a non-polarized light beam. The non-polarized light beam may be a broadband visible light beam. The metal layer may include copper, aluminum, tungsten, tantalum, titanium or cobalt. The metal layer may be copper. The metal layer may have a thickness equal to or less than 600 Angstroms. The polishing endpoint may be a desired thickness equal to or less than 600 Angstroms, or may be exposure of the underlying layer structure. A position on the substrate for each spectrum of the sequence of measured spectra may be determined, the measured spectra may be sorted into groups with each group associated with a different zone of a plurality of zones on the substrate. At least one adjusted polishing pressure for at least zone of the plurality of zones may be calculated based on the measured spectra. A polishing endpoint may be determined from the sequence of measured spectra. An adjustment for the polishing rate may be determined from the sequence of measured spectra.

In another aspect, a computer-readable medium has stored thereon instructions, which, when executed by a processor, causes the processor to perform operations of the above method.

Implementations can include one or more of the following potential advantages. Clearance of a metal layer from an underlying layer can be detected with greater precision. Polishing of a metal layer can be halted reliably at thicknesses less than 600 Angstroms. Within-wafer non-uniformity (WIWNU) can be reduced. Clearance of an overlying layer, e.g., a metal layer, can occur substantially simultaneously over the surface of the substrate, which can improve polishing throughput.

The details of one or more embodiments are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

In some semiconductor chip fabrication processes an overlying layer, e.g., a metal, such as copper, tungsten, aluminum, titanium, tantalum or cobalt, is deposited over a patterned underlying layer structure, e.g., a stack of one or more other layers. The one or more other layers can include layers of dielectric material, e.g., a low-k material and/or a low-k cap material, or of barrier metal, e.g., tantalum nitride or titanium nitride. Often the metallic layer is polished until it is "cleared", i.e., until the top surface of the underlying layer structure is exposed. Portions of the metallic layer may be left in trenches, holes, etc., provided by the pattern of the underlying layer or layer structure.

Figure 1A:
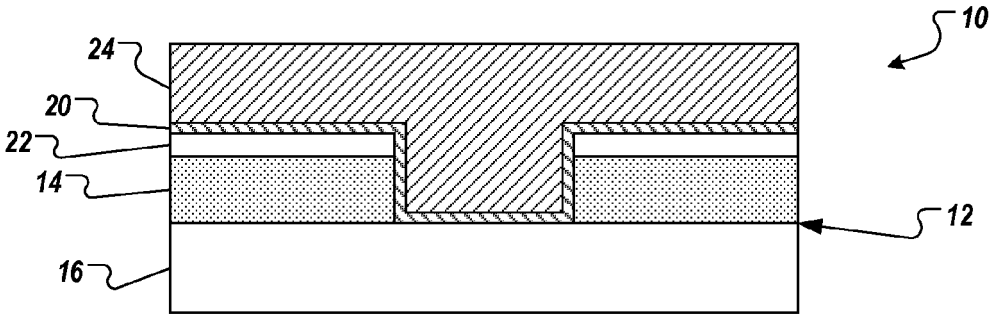
FIGS. 1A-1D are schematic cross-sectional views of a substrate before, during and after polishing.

As an example, referring to FIG. 1A, a substrate 10 can include an underlying layer structure 12, which includes a patterned dielectric layer 14 disposed over a glass sheet or semiconductor wafer 16, possibility with further layers of conductive and/or insulating material between the dielectric layer 14 and the wafer 16. The dielectric layer 14 can be an insulator, e.g., an oxide, such as silicon dioxide, or a low-k material, such as carbon doped silicon dioxide, e.g., Black Diamond™ (from Applied Materials, Inc.) or Coral™ (from Novellus Systems, Inc.).

The underlying layer structure can also optionally include a barrier layer 20 of different composition than the dielectric layer 14 that is disposed over the dielectric layer 14 and into the trenches. For example, the barrier layer 20 can be a metal or a metal nitride, e.g., tantalum nitride or titanium nitride. The underlying layer structure can also optionally include one or more additional layers 22 disposed between the dielectric layer 14 and the barrier layer 20. The additional layers 22 are of another dielectric material different from the material of the dielectric layer 14, e.g., a low-k capping material, e.g., a material formed from tetraethyl orthosilicate (TEOS).

Disposed over the underlying layer structure and at least into the trenches is a metallic layer 24, e.g., a metal, such as copper, tungsten, aluminum, titanium, tantalum or cobalt. The metallic layer 24 can be a material with an extinction coefficient greater than 1.5 over all of the visible spectrum.

In general, it would be desirable to have the portions of the metallic layer 24 outside the trenches polished to a very small but uniform thickness, or be cleared completely (e.g., no discontinuous regions of the metallic layer coating the top surface of the underlying layer or layer structure) and at substantially the same time across the surface of the substrate. This can avoid overpolishing, improve throughput and reduce within-wafer non-uniformity (WIWNU).

A problem with monitoring of polishing of the metallic layer is that for some materials, e.g., metals with low transmission, optical (e.g., spectrographic) monitoring of the substrate may not provide useful information regarding the thickness of the metallic layer during bulk polishing. Without being limited to any particular theory, at wavelengths typically used for optical monitoring, e.g., in the visible light range, the extinction coefficient of the material of the metallic layer may be sufficiently high that the reflectivity may not appreciably change as the thickness is reduced during bulk polishing. As such, optical monitoring may not be suitable for in-situ feedback control of polishing parameters during bulk polishing of some materials.

In addition, for some of these same materials, eddy current monitoring is not sufficiently effective in detecting clearance of the metallic layer. For example, at very low thicknesses, the metallic layer may not provide a sufficiently strong signal to accurately track thickness as polishing progresses.

However, the metallic layer 24 can be sufficiently thin that at least some portion of the light from the optical monitoring system is transmitted through the metallic layer 24. For example, the metallic layer 24, e.g., for the case of copper, can have a thickness of 600 Angstroms or less, e.g., 500 Angstroms or less, e.g., 400 Angstroms or less.

Figure 1B:
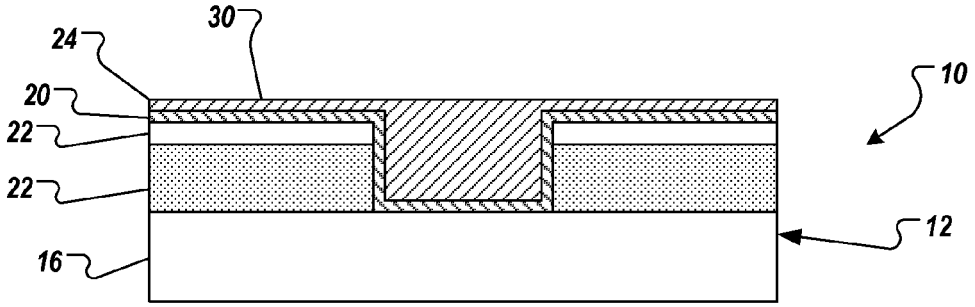

Referring to FIG. 1B, for a metallic layer 24 with a relatively large extinction coefficient, at sufficiently small thicknesses, some light will be reflected from the outer surface 30 of the metallic layer 24, and some light will pass through the metallic layer 24. Some of the light that passes through the metallic layer 24 will be reflected from the underlying layer structure 12. The light reflected from the outer surface 30 will interfere with the light reflected from the underlying layer structure 12, creating a spectrum that varies with the thickness of the metallic layer 24. This permits spectrographic monitoring techniques to be applied to detect a polishing endpoint, either for a preset thickness of the metallic layer 24, or for clearance of the metallic layer 24 from the underlying layer structure 12.

Figure 8:
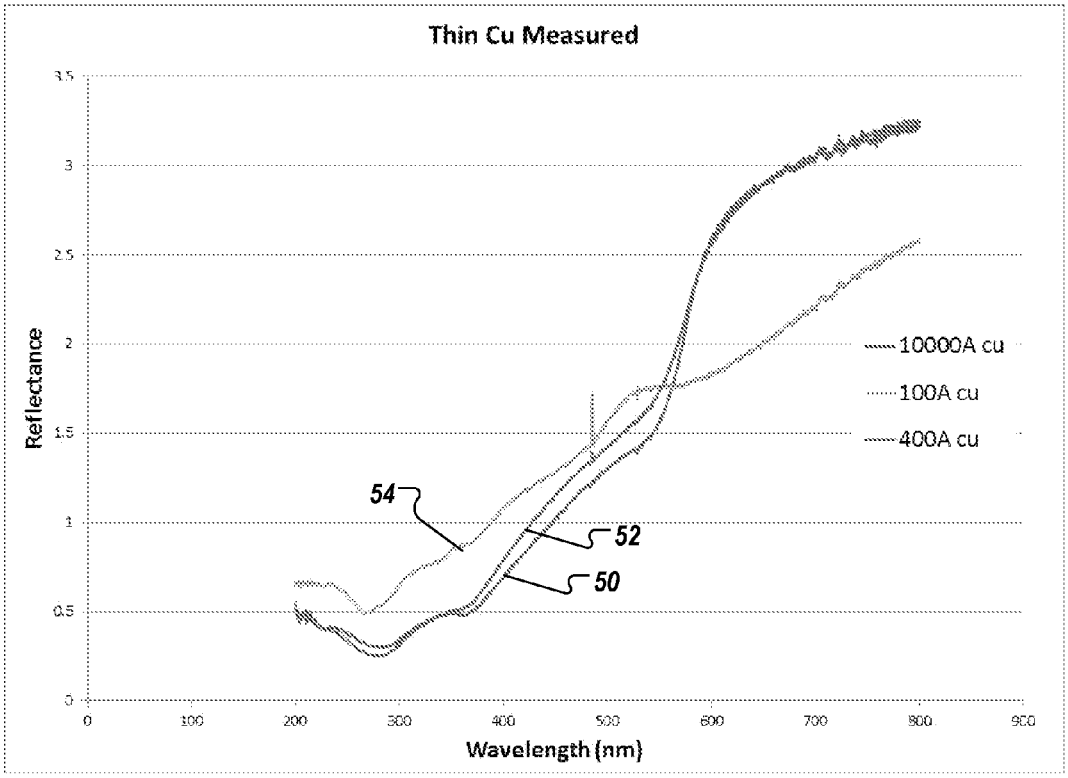
FIG. 8 illustrates spectra from a substrate having metal layers of different thickness.

For example, FIG. 8, illustrates three spectra 50, 52, 54, measured for substrates with copper layers having thicknesses of 10000 Angstroms, 400 Angstroms and 100 Angstroms, respectively. There is relatively little difference between the spectra 50 and 52 for the copper layers having thicknesses of 10000 and Angstroms and 400 Angstroms (again, without being limited to any particular theory, presumably because the extinction coefficient of copper is sufficiently high that the reflectivity does not appreciably change over this thickness range). In contrast, there is more appreciable difference between the spectra 52 and 54 for the copper layers having thicknesses of 400 and Angstroms and 100 Angstroms, respectively. The spectral change for these test wafers is similar to simulations of substrates with copper layers of similar thicknesses. Therefore, in principle, it should be possible to detect copper layer thickness or change in copper layer thickness at thickness less than about 400 Angstroms using spectrographic techniques. Some simulation results show that it may be possible to detect copper layer thickness or change in copper layer thickness at thickness less than about 600 A.

Chemical mechanical polishing can be used to planarize the substrate until the metallic layer 24 reaches a target thickness or the underlying layer structure 12 is exposed. For example, as shown in FIG. 1B, initially the metallic layer 24 is polished until it is sufficiently thin for optical monitoring to be performed. Alternatively, the metallic layer 24 is polished until the underlying layer structure 12, e.g., the barrier layer 22, is exposed.

Figure 1C:
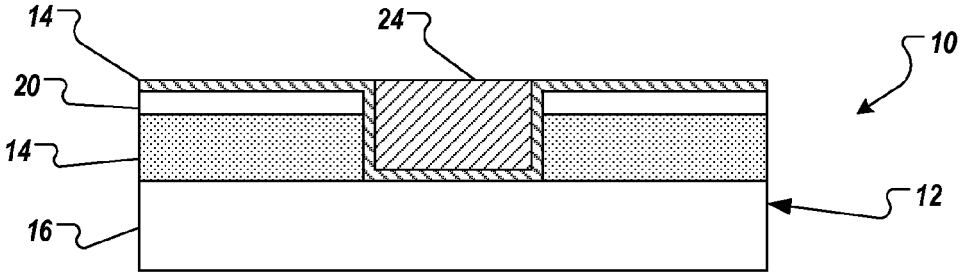
Figure 1D:
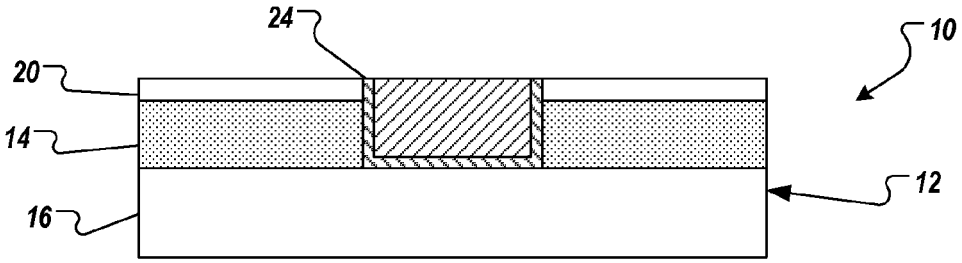

Then, referring to FIG. 1D, the portion of the barrier layer 22 and/or the other dielectric layers 20 remaining over the dielectric layer 14 is removed and the substrate is polished until the dielectric layer 14, is exposed. In addition, it is sometimes desired to polish the first layer, e.g., the dielectric layer 22, until a target thickness remains or a target amount of material has been removed. In the example of FIGS. 1A-1C, after planarization, the portions of the metallic layer 24 remaining between the raised pattern of the dielectric layer 14 form vias and the like.

One method of polishing is to polish the metallic layer 24 on a first polishing pad at least until the underlying layer structure, e.g., the barrier layer 22, is exposed. The substrate is then transferred to a second polishing pad, where the barrier layer 26 is completely removed, and a portion of the thickness of the first layer, e.g., upper dielectric layer 22, such as the low-k dielectric, is also removed. In addition, if present, the additional layer or layers, e.g., the capping layer, between the first and second layer can be removed in the same polishing operation at the second polishing pad.

Figure 2:
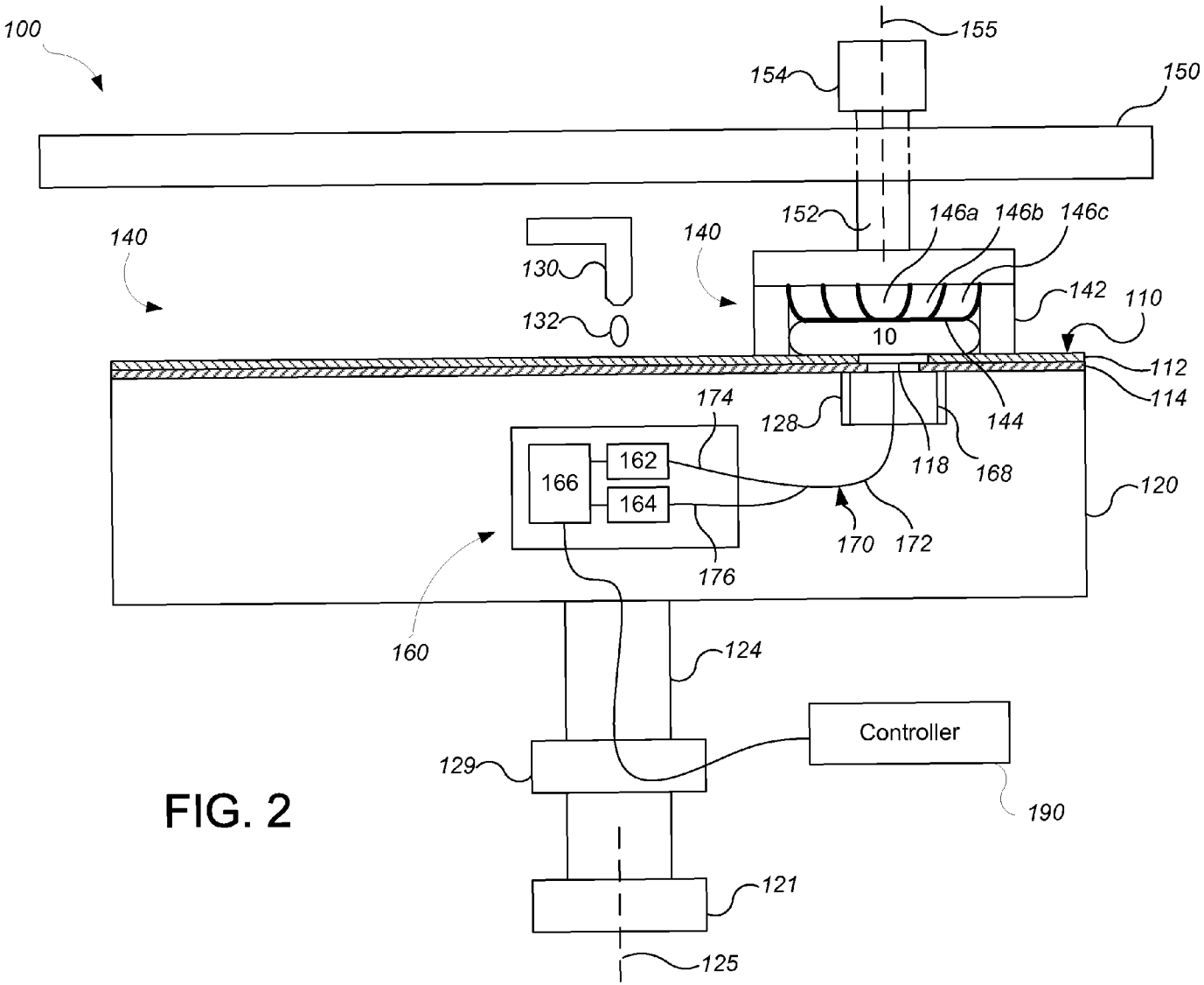
FIG. 2 illustrates a schematic cross-sectional view of an example of a polishing apparatus.

FIG. 2 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. Each carrier head 140 can have independent control of the polishing parameters, for example pressure, associated with each respective substrate.

Figure 3:
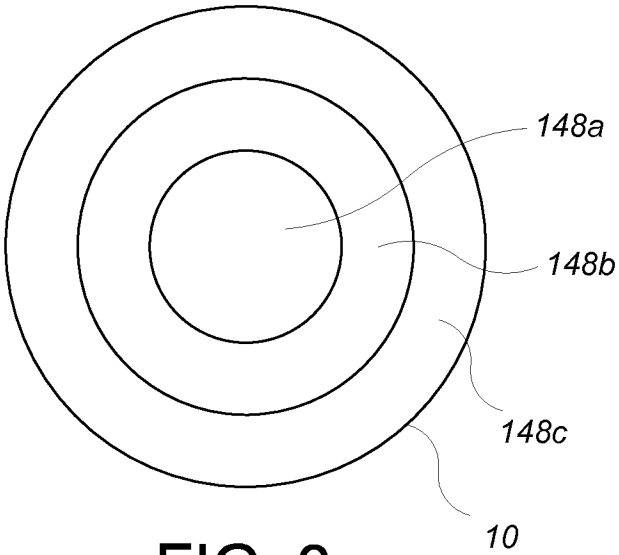
FIG. 3 illustrates a schematic top view of a substrate having multiple zones.

In particular, each carrier head 140 can include a retaining ring 142 to retain the substrate 10 below a flexible membrane 144. Each carrier head 140 also includes a plurality of independently controllable pressurizable chambers defined by the membrane, e.g., three chambers 146*a*-146*c*, which can apply independently controllable pressurizes to associated zones 148*a*-148*c* on the flexible membrane 144 and thus on the substrate 10 (see FIG. 3). Referring to FIG. 3, the center zone 148*a* can be substantially circular, and the remaining zones 148*b*-148*c* can be concentric annular zones around the center zone 148*a*. Although only three chambers are illustrated in FIGS. 2 and 3 for ease of illustration, there could be one or two chambers, or four or more chambers, e.g., five chambers.

Returning to FIG. 2, each carrier head 140 is suspended from a support structure 150, e.g., a carousel, and is connected by a drive shaft 152 to a carrier head rotation motor 154 so that the carrier head can rotate about an axis 155. Optionally each carrier head 140 can oscillate laterally, e.g., on sliders on the carousel 150; or by rotational oscillation of the carousel itself. In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes an in-situ optical monitoring system 160, which is a spectrographic monitoring system and which can be used to determine a polishing endpoint or an adjustment for the polishing rate. An optical access through the polishing pad is provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber an include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). The spectrum can be measured over the visible light range, e.g., 200-800 nm. A potential advantage of using visible light is that the optical monitoring system used for thin metal layers can also be used for dielectric materials. Another potential advantage of using visible light rather than infrared light is greater sensitivity to thickness change (the spectrum tends to change more rapidly with thickness at shorter wavelengths).

As noted above, the light source 162 and light detector 164 An advantage of using visible light can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some implementations, the light source 162 and detector 164 of the in-situ monitoring system 160 are installed in and rotate with the platen 120. In this case, the motion of the platen will cause the sensor to scan across each substrate. In particular, as the platen 120 rotates, the controller 190 can cause the light source 162 to emit a series of flashes starting just before and ending just after the optical access passes below the substrate 10. Alternatively, the computing device can cause the light source 162 to emit light continuously starting just before and ending just after each substrate 10 passes over the optical access. In either case, the signal from the detector can be integrated over a sampling period to generate spectra measurements at a sampling frequency.

In operation, the controller 190 can receive, for example, a signal that carries information describing a spectrum of the light received by the light detector for a particular flash of the light source or time frame of the detector. Thus, this spectrum is a spectrum measured in-situ during polishing.

Figure 4:
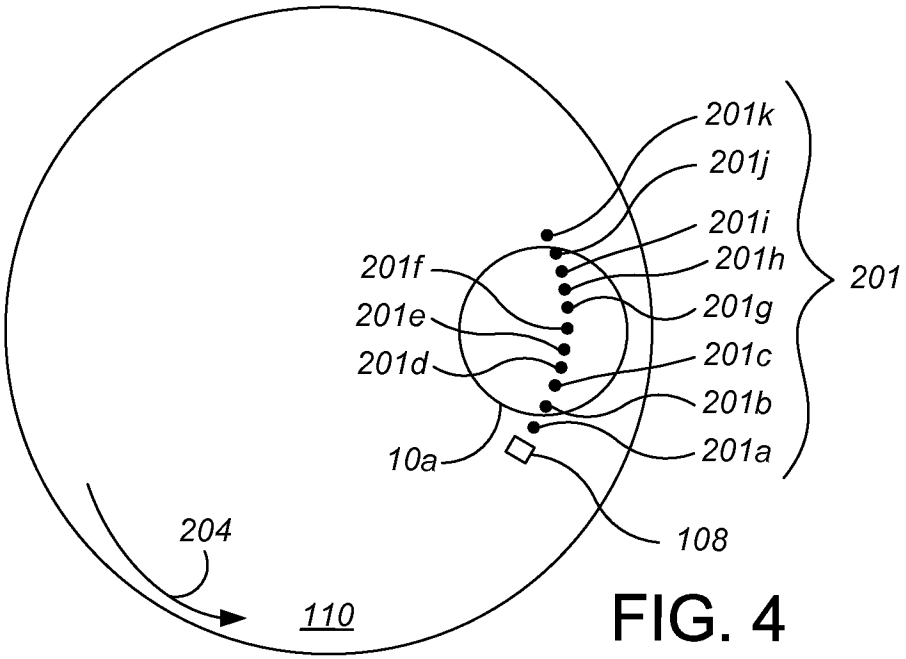
FIG. 4 illustrates a top view of a polishing pad and shows locations where in-situ measurements are taken on a substrate.

As shown by in FIG. 4, if the detector is installed in the platen, due to the rotation of the platen (shown by arrow 204), as the window 108 travels below a carrier head, the optical monitoring system making spectra measurements at a sampling frequency will cause the spectra measurements to be taken at locations 201 in an arc that traverses the substrate 10. For example, each of points 201*a*-201*k* represents a location of a spectrum measurement by the monitoring system (the number of points is illustrative; more or fewer measurements can be taken than illustrated, depending on the sampling frequency). The sampling frequency can be selected so that between five and twenty spectra are collected per sweep of the window 108. For example, the sampling period can be between 3 and 100 milliseconds.

As shown, over one rotation of the platen, spectra are obtained from different radii on the substrate 10. That is, some spectra are obtained from locations closer to the center of the substrate 10 and some are closer to the edge. Thus, for any given scan of the optical monitoring system across a substrate, based on timing, motor encoder information, and optical detection of the edge of the substrate and/or retaining ring, the controller 190 can calculate the radial position (relative to the center of the substrate being scanned) for each measured spectrum from the scan. The polishing system can also include a rotary position sensor, e.g., a flange attached to an edge of the platen that will pass through a stationary optical interrupter, to provide additional data for determination of which substrate and the position on the substrate of the measured spectrum. The controller can thus associate the various measured spectra with the controllable zones 148*b*-148*e* (see FIG. 2) on the substrates 10*a* and 10*b*. In some implementations, the time of measurement of the spectrum can be used as a substitute for the exact calculation of the radial position.

Over multiple rotations of the platen, for each zone, a sequence of spectra can be obtained over time. Without being limited to any particular theory, the spectrum of light reflected from the substrate 10 evolves as polishing progresses (e.g., over multiple rotations of the platen, not during a single sweep across the substrate) due to changes in the thickness of the metallic layer, thus yielding a sequence of time-varying spectra. In short, particular spectra are exhibited by particular thicknesses of the metallic layer.

Figure 5:
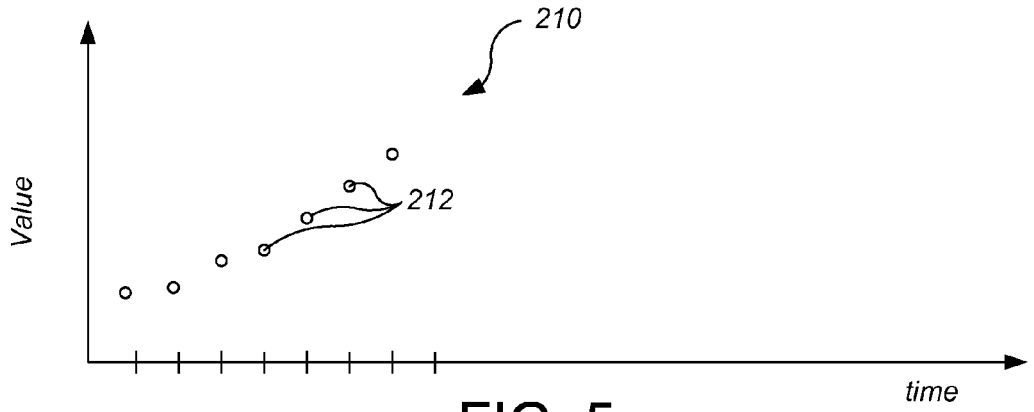
FIG. 5 illustrates a sequence of values generated from a sequence of measured spectra.

Referring to FIG. 5, a sequence 210 of values 212, e.g., scalar values, is generated from the sequence of spectra.

In some implementations, the controller, e.g., the computing device, can be programmed to compare each measured spectrum to a reference spectra and to determine the difference between the measured spectrum and the reference spectrum to create a sequence of difference values, e.g., as described in U.S. Pat. No. 7,764,377, which is incorporated by reference. In this case, the sequence 210 of values 212 is a sequence of difference values.

In some implementations, the controller, e.g., the computing device, can be programmed to compare each measured spectrum to multiple reference spectra and to determine which reference spectrum provides the best match, e.g., as described in U.S. Pat. No. 7,764,377. In particular, the controller can be programmed to compare each spectrum from a sequence of measured spectra from each zone to multiple reference spectra to generate a sequence of best matching reference spectra for each zone.

As used herein, a reference spectrum is a predefined spectrum generated prior to polishing of the substrate. A reference spectrum can have a pre-defined association, i.e., defined prior to the polishing operation, with a value representing a time in the polishing process at which the spectrum is expected to appear (e.g., an "index value"), assuming that the actual polishing rate follows an expected polishing rate. In this case, the sequence 210 of values 212 is a sequence of index values. Alternatively or in addition, the reference spectrum can have a pre-defined association with a value of a substrate property, such as a thickness of the outermost layer. In this case, the sequence 210 of values 212 is a sequence of thickness values.

In some implementations, the controller, e.g., the computing device, can be programmed to identify a selected peak or valley in each measured spectrum, and measure a characteristic of the peak or valley, e.g., the location or width (in frequency or wavelength) of the peak or valley, e.g., as described in U.S. Patent Pub. No. 2008-0099443. In this case, the sequence 210 of values 212 is a sequence of location or width (in frequency or wavelength) values.

Figure 6:
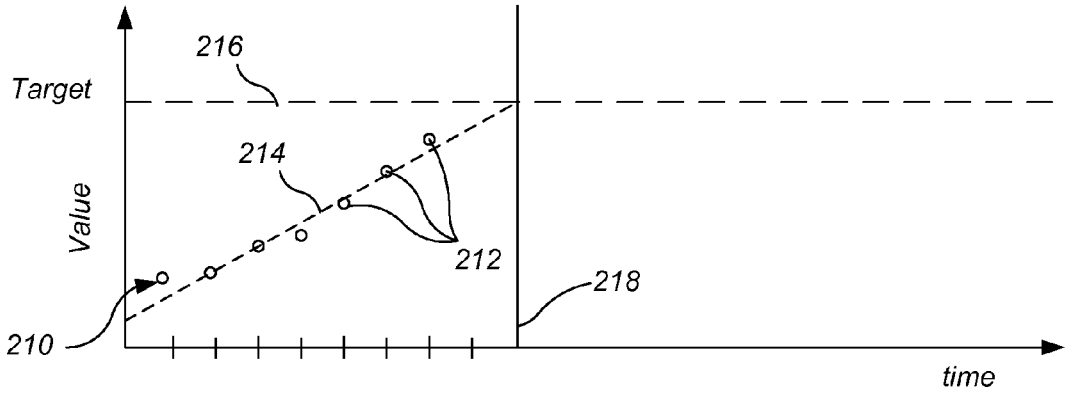
FIG. 6 illustrates a function fit to the sequence of values.

The controller 190 can process the sequence of values to determine when the metallic layer reaches a target thickness, or when the underlying layer structure is exposed, to determine the polishing endpoint. In some implementations, the controller can indicate an endpoint when the value reaches a target value or changes by a threshold amount. In addition, referring to FIG. 6, a function 214 can be fit to the sequence 210 of values 212, and a time 218 at which the function 214 is projected to reach a target value 216 can be used as the endpoint time. In some implementations, the controller can indicate an endpoint when the value reaches a minimum.

Figure 7:
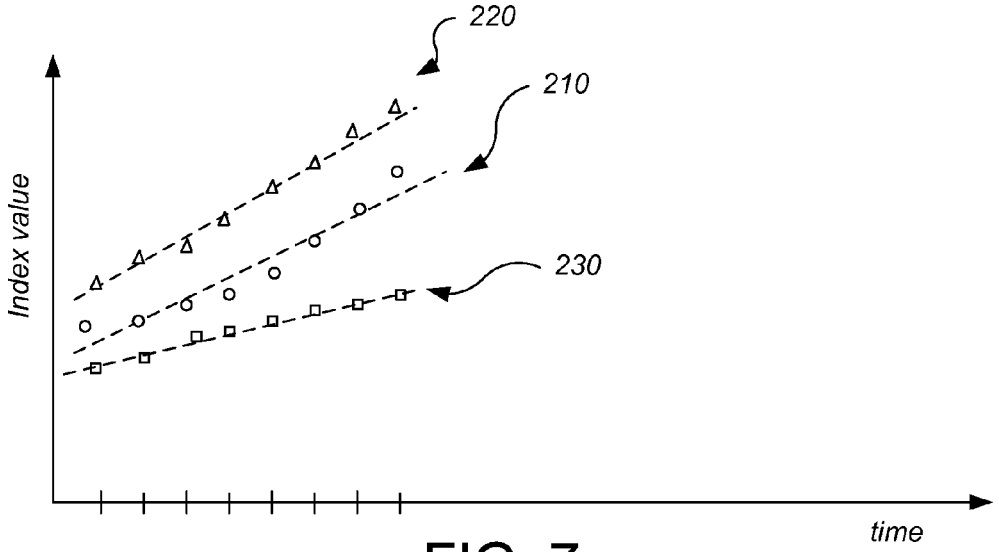
FIG. 7 illustrates a plurality of sequences of values from different zones on the substrate.

Referring to FIG. 7, if the measured spectra are sorted by zone on the substrate, there can be multiple sequences of values, e.g., a sequence of values for each zone. The zones can correspond to the independently controllable regions 148*a*, 148*b*, 148*c* on the substrate. For example, if the measured spectra are sorted into three radial zones, then three corresponding sequences of values, e.g., sequences 210, 220 and 230, can be generated. The controller 190 can use this information to adjust the polishing parameters, e.g., pressure in one of the carrier head chambers, in order to improve polishing uniformity.

Implementations and all of the functional operations described in this specification can be implemented in digital electronic circuitry, or in computer software, firmware, or hardware, including the structural means disclosed in this specification and structural equivalents thereof, or in combinations of them. Implementations described herein can be implemented as one or more computer program products, i.e., one or more computer programs tangibly embodied in a machine readable storage device, for execution by, or to control the operation of, data processing apparatus, e.g., a programmable processor, a computer, or multiple processors or computers.

A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The above described polishing apparatus and methods can be applied in a variety of polishing systems. Either the polishing pad, or the carrier head, or both can move to provide relative motion between the polishing surface and the wafer. For example, the platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and wafer can be held in a vertical orientation or some other orientations.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

While this specification contains many specifics, these should not be construed as limitations on the scope of any invention or of what may be claimed, but rather as descriptions of features that may be specific to particular embodiments of particular inventions. For example, in some implementations, the method could be applied to a semimetal, or an alloy of a metal and a semimetal, e.g., GeSbTe (a ternary compound of germanium, antimony and tellurium, also known as GST). In some implementations, the method could be applied to other materials having an extinction coefficient greater than 1.5 over all of the visible spectrum.

What is claimed is:

1. A method of controlling polishing, comprising:

polishing a metal layer of a substrate, the metal layer overlying a patterned dielectric layer;

during polishing, directing a light beam onto the substrate, wherein the metal layer is sufficiently thin that a portion of the light beam reflects from an exposed surface of the metal layer and a portion of the light beam passes through the metal layer and reflects from the patterned dielectric layer to generate a reflected light beam;

during polishing while the metal layer covers the patterned dielectric layer so that the patterned dielectric layer is not exposed and the metal layer is sufficiently thin that the portion of the light beam passes through the metal layer and reflects from the dielectric layer to generate the reflected light beam, monitoring the reflected light beam and generating a sequence of measured spectra from the reflected light beam; and determining at least one of a polishing endpoint or an adjustment for a polishing rate from the sequence of measured spectra.

2. The method of claim 1, wherein the light beam is a non-polarized light beam.

3. The method of claim 2, wherein the non-polarized light beam comprises a broadband visible light beam.

4. The method of claim 1, wherein the metal layer comprises copper, aluminum, tungsten, tantalum, titanium or cobalt.

5. The method of claim 1, further comprising determining a position on the substrate for each spectrum of the sequence of measured spectra, and sorting the measured spectra into groups with each group associated with a different zone of a plurality of zones on the substrate.

6. The method of claim 5, further comprising calculating at least one adjusted polishing pressure for at least one zone of the plurality of zones based on the measured spectra.

7. The method of claim 1, comprising determining a polishing endpoint from the sequence of measured spectra.

8. The method of claim 1, determining an adjustment for the polishing rate from the sequence of measured spectra.

9. The method of claim 1, wherein the metal layer has an extinction coefficient greater than 1.5 for all the visible spectrum.

10. The method of claim 1, wherein polishing the metal layer includes initially polishing the metal layer with a polishing pad, wherein the initially polishing polishes the metal layer at thicknesses sufficient that changes in metal layer thickness are not detected from the sequence of measured spectra.

11. The method of claim 10, wherein initially polishing the metal layer comprises polishing the metal layer at thicknesses greater than 600 Angstroms.

12. The method of claim 10, comprising, after initially polishing the metal layer, continuing to polish the metal layer until changes in metal layer thickness are detected from the sequence of measured spectra.

13. The method of claim 12, wherein continuing to polish comprises polishing the metal layer at thicknesses less than 600 Angstroms.

14. A method of controlling polishing, comprising:

polishing a metal layer of a substrate, the metal layer overlying an underlying layer structure;

during polishing, directing a light beam onto the substrate, wherein the metal layer is sufficiently thin that a portion of the light beam reflects from an exposed surface of the metal layer and a portion of the light beam passes through the metal layer and reflects from the underlying layer structure to generate a reflected light beam;

during polishing, monitoring the reflected light beam and generating a sequence of measured spectra from the reflected light beam; and determining at least one of a polishing endpoint or an adjustment for a polishing rate from the sequence of measured spectra;

wherein detecting the polishing endpoint comprises detecting in the sequence of measured spectra an increase in reflectance at wavelengths less than about 400 Angstroms and a decrease in reflectance at wavelengths greater than 600 Angstroms.

15. The method of claim 14, wherein the metal layer consists of copper.

16. The method of claim 15, wherein the metal layer has a thickness equal to or less than 600 Angstroms.

17. The method of claim 16, wherein the polishing endpoint is a desired thickness equal to or less than 600 Angstroms.

18. The method of claim 16, wherein the polishing endpoint is exposure of the underlying layer structure.

* * * * *